United States Patent [19]

Anderson

[11] Patent Number: 4,959,584

[45] Date of Patent: Sep. 25, 1990

[54] LUMINAIRE FOR AN ELECTRODELESS HIGH INTENSITY DISCHARGE LAMP

[75] Inventor: John M. Anderson, Scotia, N.Y.

[73] Assignee: General Electric Company, Schenectady, N.Y.

[21] Appl. No.: 370,664

[22] Filed: Jun. 23, 1989

[51] Int. Cl.[5] ..... H01J 1/50; H01J 63/02

[52] U.S. Cl. ..... 313/160000; 313/493

[58] Field of Search ..... 313/160, 161, 493; 315/57, 248

[56] References Cited

U.S. PATENT DOCUMENTS

| | | | |
|---|---|---|---|
| 3,763,392 | 10/1973 | Hollister | 315/248 |
| 3,787,705 | 1/1974 | Bolin et al. | 315/248 |
| 3,860,854 | 1/1975 | Hollister | 315/248 |
| 4,065,701 | 12/1977 | Haugsjaa et al. | 315/248 |
| 4,810,938 | 3/1989 | Johnson et al. | 315/248 |
| 4,812,702 | 3/1989 | Anderson | 313/153 |

*Primary Examiner*—Sandra L. O'Shea

*Attorney, Agent, or Firm*—Jill M. Breedlove; James C. Davis, Jr.; Marvin Snyder

[57] ABSTRACT

A luminaire for an electrodeless high intensity discharge lamp houses a replaceable lamp. The lamp is insertable into the socket of the luminaire which has an excitation coil attached thereto. The lamp may include light-reflecting cones for maximizing light output from the arc tube and starting electrodes for initiating the arc discharge in the plasma of the arc tube.

32 Claims, 2 Drawing Sheets

TO HIGH VOLTAGE PULSING MEANS
38
36

35
16
14
8
30
26
10
12
32
20
19
21
21
34
28
40
20
20
23
23
42
22
24
25
RF POWER SUPPLY
HIGH VOLTAGE PULSING MEANS 44
12
46
HIGH VOLTAGE PULSING MEANS

LUMINAIRE FOR AN ELECTRODELESS HIGH INTENSITY DISCHARGE LAMP

FIELD OF THE INVENTION

The present invention relates generally class to a of high intensity discharge lamps for which the arc discharge is generated by a solenoidal electric field, i.e. HID-SEF lamps. More particularly, the present invention relates to luminaire for housing an electrodeless HID-SEF lamp which is easily and conveniently replaceable therein.

BACKGROUND OF THE INVENTION

In a high intensity discharge (HID) lamp, a medium to high pressure ionizable gas, such as mercury or sodium vapor, emits visible radiation upon excitation typically caused by passage of radio frequency (RF) current through the gas. In the original class of HID lamps, discharge current was caused to flow between two electrodes. However, a major cause of early electroded HID lamp failure has been found attributable to at least two inherent operational characteristics of such lamps. First, during lamp operation, sputtering of electrode material onto the lamp envelope is common and reduces optical output. Second, thermal and electrical stresses often result in electrode failure.

Electrodeless HID lamps do not exhibit these life-shortening phenomena found in electroded HID lamps. One class of electrodeless HID lamps involves generating an arc discharge by establishing a solenoidal electric field in the gas; and, hence, these lamps are referred to as HID-SEF lamps. In an HID-SEF lamp, the discharge plasma or fill is excited by RF current in an excitation coil surrounding the arc tube. The HID-SEF arc tube and excitation coil assembly acts essentially as a transformer which couples RF energy to the plasma. In particular, the excitation coil acts as a primary coil, and the plasma functions as a single-turn secondary. RF current in the excitation coil produces a changing magnetic field, in turn creating an electric field in the plasma which closes completely upon itself, i.e., a solenoidal electric field. Current flows as a result of this electric field, thus producing a toroidal arc discharge in the arc tube.

For efficient lamp operation, the excitation coil must not only have satisfactory coupling to the discharge plasma, but must also have low resistance and small size. A practical coil configuration permits only minimal light blockage by the coil and hence maximizes light output. A conventional excitation coil is of a long solenoidal shape. However, another excitation coil configuration is disclosed in U.S. Pat. No. 4,812,702 issued on Mar. 14, 1989 to J. M. Anderson and assigned to the instant assignee. The excitation coil of the cited patent, which is hereby incorporated by reference, has at least one turn of a conductor arranged generally upon the surface of a toroid with a rhomboid or V-shaped cross-section that is substantially symmetrical about a plane passing through the maxima of the toroid. Still another type of excitation coil for an HID-SEF lamp is described in commonly assigned copending U.S. patent application Ser. No. 240,331 of H. L. Witting, filed on Sept. 6, 1988 now U.S. Pat. No. 4,894,591, which incorporated by reference. The Witting application describes an inverted excitation coil comprising first and second solenoidally-wound coil portions, each being disposed upon the surface of an imaginary cone having its vertex situated within the arc tube or within the volume of the other coil portion.

Despite the advantages offered by HID-SEF lamps, luminaires for housing HID-SEF lamps which allow for both efficient operation and easy lamp replacement have been heretofore unknown. Accordingly, it is an object of the present invention to provide such a luminaire.

Another object of the present invention is to provide an HID-SEF luminaire which has an excitation coil attached thereto and allows for easy lamp replacement, the new luminaire being simple in construction and easy to fabricate.

Still another object of the present invention is to provide an HID-SEF luminaire which houses an easily replaceable HID-SEF lamp with light reflecting means for maximizing light output from the lamp arc tube.

Yet another object of this invention is to provide an HID-SEF lamp, including starting electrodes, which is easily and conveniently replaceable in a luminaire.

SUMMARY OF THE INVENTION

The foregoing and other objects of the present invention are achieved in a novel luminaire for an HID-SEF lamp in which the lamp is easily and conveniently replaceable, the luminaire having an excitation coil attached thereto. The preferred embodiment of the new HID-SEF lamp comprises an elongated, light-transmissive envelope surrounding a light-transmissive arc tube. There are preferably light reflecting cones within the lamp at either end of the envelope to maximize light output from the lamp. A getter, such as a nickel-barium getter, may also be contained within the envelope, if desired. The lamp further may incorporate a thermal jacket surrounding the arc tube in order to maintain the arc tube at a uniformly warm temperature during lamp operation. Still further, the lamp envelope may include starting electrodes.

One end of the lamp includes a base, such as a conventional screw, plug or bayonet base, for insertion into a corresponding type socket of the luminaire. The excitation coil of the HID-SEF lamp is directly affixed to the luminaire and is supported thereby. Advantageously, the HID-SEF lamp is insertable through the excitation coil into the socket of the luminaire for easy and convenient installation and replacement.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
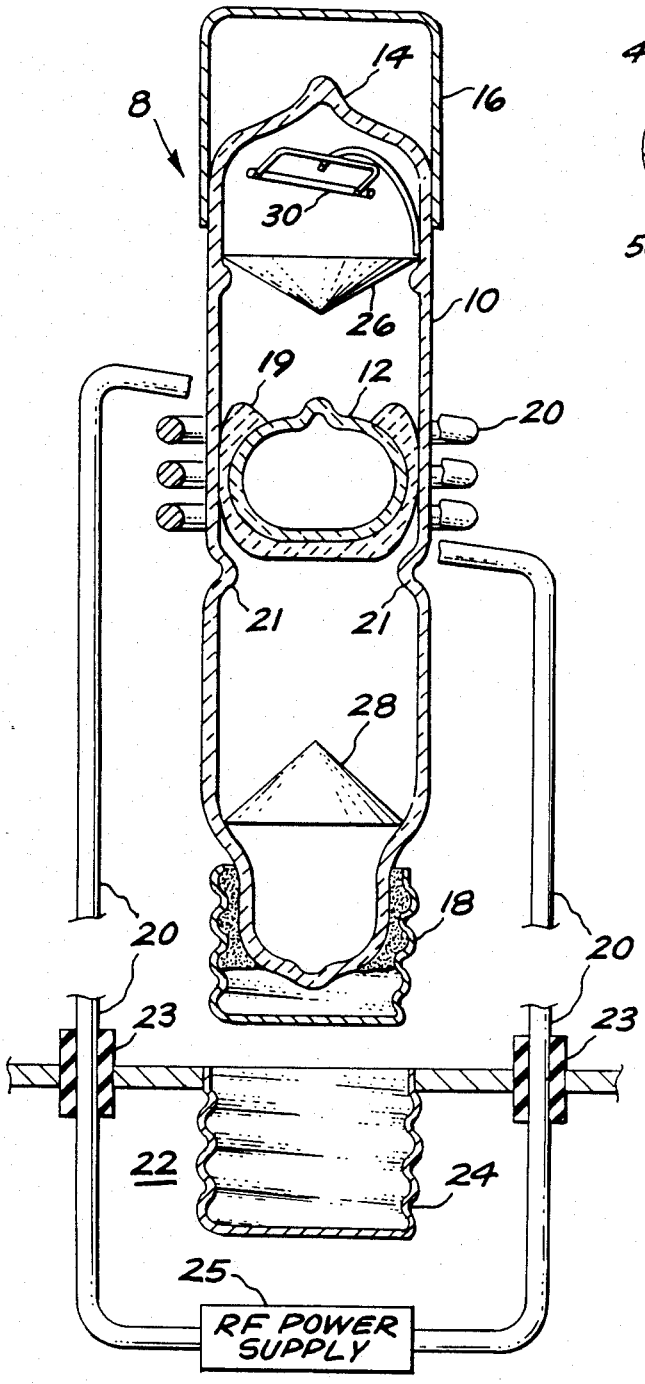
FIG. 1 is a cross-sectional side view of an HID-SEF luminaire including an easily replaceable HID-SEF lamp constructed in accordance with the present invention.

FIG. 1 shows a luminaire housing an HID-SEF lamp constructed in accordance with the present invention. The preferred embodiment of the HID-SEF lamp comprises a lamp 8 having an elongated, light-transmissive outer envelope 10, such as glass, enclosing an arc tube 12 also made of a light-transmissive material, such as fused quartz or polycrystalline alumina. Envelope 10 includes a typical exhaust tip 14 for evacuation and backfill of gas in the space between arc tube 12 and envelope 10. The preferred embodiment also includes a retaining cap 16, preferably comprised of metal, for protecting the exhaust tip seal as well as the lamp. Envelope 10 further includes a base 18 for insertion into the corresponding type socket of a luminaire, to be described hereinafter.

Arc tube 12 is shown as a short, substantially cylindrical structure with rounded edges. Such a structure advantageously enables relatively isothermal lamp operation. However, other arc tube structures, e.g. spherical, may be suitable depending upon the particular application of the lamp. Arc tube 12 is preferably surrounded by an insulating layer or thermal jacket 19 to limit cooling thereof. Thermal jacket 19 also serves as a cradle resting on retainers 21, i.e. indentations in envelope 10, for supporting arc tube 12. A suitable insulating layer is made of a high temperature refractory material, such as quartz wool, as described in commonly assigned U.S. Pat. No. 4,810,938 issued on Mar. 7, 1989 to P. D. Johnson, J. T. Dakin and J. M. Anderson, which is hereby incorporated by reference. Quartz wool is comprised of thin fibers of quartz which are nearly transparent to visible light, but which diffusely reflect infrared radiation. If thermal jacket 19 is not required for insulation, then alternative means of support may be needed, such as a supporting quartz network or framework (not shown).

Arc tube 12 contains a fill in which a solenoidal arc discharge is excited during lamp operation. A suitable fill, described in U.S. Pat. No. 4,810,938, hereinabove cited, comprises a sodium halide, a cerium halide and xenon combined in weight proportions to generate visible radiation exhibiting high efficacy and good color rendering capability at white color temperatures. Specifically, such a fill may comprise, for example, sodium iodide and cerium chloride, in equal weight proportions, in combination with xenon at a partial pressure of about 500 torr. Another suitable fill is described in copending U.S. patent application Ser. No. 348,433 of H. L. Witting, filed on May 8, 1989 and assigned to the instant assignee. The fill of this patent application comprises a combination of a lanthanum halide, a sodium halide, a cerium halide and xenon or krypton as a buffer gas. Such a fill may comprise, for example, a combination of lanthanum iodide, sodium iodide, cerium iodide, and 250 torr partial pressure of xenon.

An excitation coil 20 surrounds arc tube 12 for exciting an arc discharge in the fill. As illustrated in FIG. 1, excitation coil 20 is a three-turn solenoidal coil. However, other suitable coil configurations may be employed, such as those hereinabove described. According to the present invention, excitation coil 20 is mechanically connected to a luminaire 22. In particular, coil 20 is shown as being surrounded by insulating material 23 at the points of connection to the luminaire. The excitation coil may be affixed permanently or temporarily to the luminaire, which also includes a socket 24. During installation or replacement of lamp 8 within luminaire 22, the lamp is merely inserted through excitation coil 20 which is coupled to an RF power supply 25, and base 18 is inserted into socket 24. As illustrated in FIG. 1, an Edison screw base-and-socket configuration is employed. However, any suitable base-and-socket configuration may be used, such as a plug type or bayonet type, the same being well known in the art.

The preferred embodiment of the present invention further comprises light reflecting means for minimizing light losses at the ends of the envelope, thereby maximizing light output from the lamp. The preferred structure of the light reflecting means comprises a light reflecting cone 26 and 28 at either end of envelope 10. Each light reflecting cone may comprise a highly polished metal, such as aluminum or silver, or a vacuum deposited layer of such metal on a glass substrate. If the metal is not highly polished, a diffuse reflecting layer is preferably applied to the metal to maximize diffuse reflectivity. Materials which exhibit low body losses, and hence form good diffuse reflecting layers, include alumina, magnesia, titania, barium sulfate, and phosphor. Alternatively, the cones may comprise a dielectric coated with a diffuse reflecting material, such as phosphor-coated glass.

If desired, a getter 30 may be incorporated into the new lamp assembly to remove traces of impurity gases in the envelope. Suitable getters, such as nickel-barium getters, are well known in the art.

Figure 4:
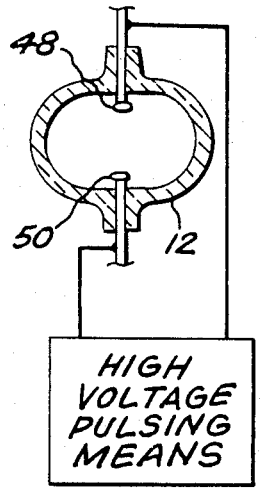
FIG. 4 is a cross-sectional side view of an alternate embodiment of an arc tube with starting electrodes useful in an HID-SEF luminaire of the present invention.
Figures 2, 3:
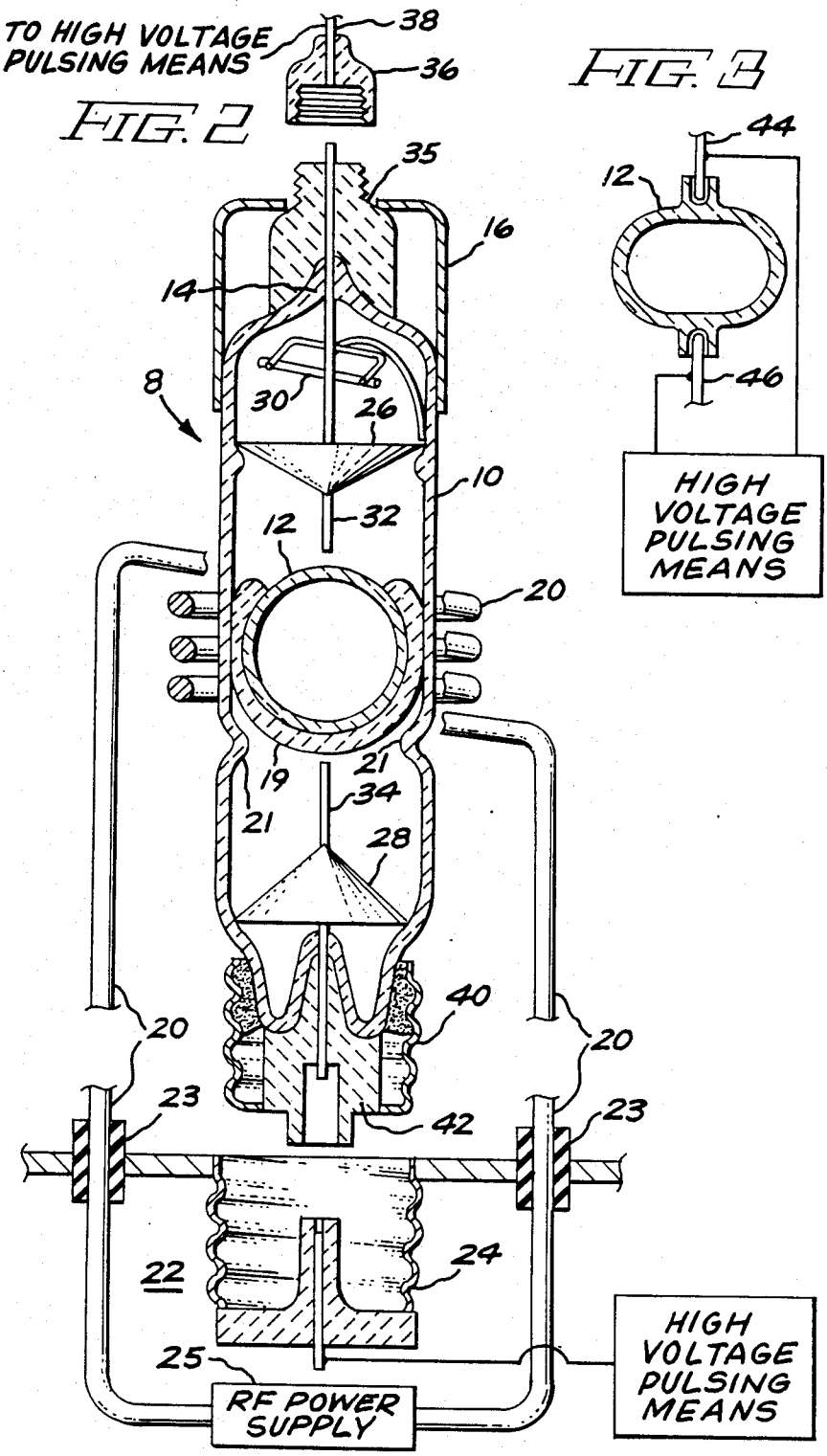
FIG. 2 is a cross-sectional side view of an alternate embodiment of an HID-SEF luminaire including an easily replaceable HID-SEF lamp constructed in accordance with the present invention.
FIG. 3- is a cross-sectional side view of an alternate embodiment of an arc tube with starting electrodes useful in an HID-SEF luminaire of the present invention.

FIGS. 2–4 illustrate alternative embodiments of the new HID-SEF lamp for use in the luminaire of the present invention, each including starting electrodes for providing at least one spark channel to assist in the initiation of the arc discharge upon receipt of a starting signal from the RF power supply. Specifically, as shown in FIG. 2, starting electrodes 32 and 34 are adjacent to arc tube 12. Electrode 32 enters envelope 10 through exhaust tip 14 which is surrounded by a dielectric material 35. A connecting cap 36 connects starting electrode 32 to a high voltage pulsing means via a lead 38. The connecting cap is insulated and is shown as having a screw configuration for attachment to the retaining cap. Electrode 34 enters envelope 10 through a plug base 40. (Alternatively, as described hereinabove, any other well known base-and-socket configuration could be used.) Electrode 34 is surrounded by a dielectric material 42 contained within base 40. The high voltage pulsing means applies an alternating voltage to electrodes 32 and 34 simultaneously with the introduction of RF power to excitation coil 20, thereby causing a starting pre-discharge to be formed within the interior of arc tube 12. This starting pre-discharge forms "spark channels" extending from a volume adjacent to one starting electrode to a volume adjacent to the other starting electrode, and also forms spark channels within the arc tube extending randomly from the vicinity of each starting electrode to the excitation coil turns. The spark channels provide spark discharges which cause some plasma to be formed. The plasma diffuses into the volume of the desired arc and ignites into a toroidal arc discharge. The operation of such starting electrodes is described in U.S. patent application Ser. No. 208,514 of J. M. Anderson, and V. D. Roberts, filed on June 20, 1988, now abandoned.

FIG. 3 illustrates another alternative embodiment of the new HID-SEF lamp wherein starting electrodes 44 and 46, which are supported in envelope 10, as shown in FIG. 2, are used to position and hold arc tube 12. With electrodes 44 and 46 thus supporting arc tube 12, retainers 21, such as those shown in FIG. 2, are not required. In still another embodiment, as shown in FIG. 4, electrodes 48 and 50, which enter arc tube 12 through gas-tight seals and are supported in envelope 10 as shown in FIG. 2, create a spark directly in the fill.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A luminaire, comprising:

a replaceable lamp comprising an elongated, light-transmissive envelope and a light-transmissive arc tube disposed within said envelope for containing a fill, said envelope having a base;

an excitation coil disposed about said envelope for exciting an arc discharge in said fill; and socket means for receiving the base of said envelope, coil retaining means for supporting said excitation coil, said coil retaining means being adapted to be connected to a radio frequency power supply for coupling radio frequency power to said fill.

2. A luminaire according to claim 1, further comprising light-reflecting means disposed within said envelope for reflecting light radiated from said arc tube through said envelope.

3. A luminaire according to claim 2 wherein said light-reflecting means comprises a light-reflecting cone disposed at each end of said envelope and along the longitudinal axis thereof.

4. A luminaire according to claim 3 wherein each said light-reflecting cone comprises a metal coated with a diffuse reflecting material.

5. A luminaire according to claim 4 wherein said diffuse reflecting material comprises barium sulfate.

6. A luminaire according to claim 4 wherein said diffuse reflecting material comprises an oxide selected from the group consisting of alumina, magnesia and titania.

7. A luminaire according to claim 4 wherein said diffuse reflecting material comprises phosphor.

8. A luminaire according to claim 3 wherein each said light-reflecting cone is comprised of a dielectric material coated with a diffuse reflecting material.

9. A luminaire according to claim 8 wherein said dielectric material comprises glass and said diffuse reflecting material comprises phosphor.

10. A luminaire according to claim 1, further comprising getter means for removing impurity gases from the space between said arc tube and said envelope.

11. A luminaire according to claim 1, further comprising thermal energy barrier means for insulating said arc tube.

12. A luminaire according to claim 1, further comprising starting electrode means for providing at least one spark channel within said envelope to assist in the initiation of said arc discharge upon receipt of a starting signal.

13. A luminaire according to claim 12 wherein said starting electrode means comprises an elongated electrode disposed at each end of said envelope and along the longitudinal axis thereof.

14. A luminaire according to claim 13 wherein each said electrode is exterior and adjacent to said arc tube.

15. The lamp assembly of claim 14 wherein each said electrode provides support for said arc tube.

16. A luminaire according to claim 13 wherein each said electrode extends from one end of said envelope into said arc tube.

17. A luminaire for receiving a replaceable electrodeless high intensity discharge lamp, said lamp having a light-transmissive arc tube for containing a fill and a substantially cylindrical, light-transmissive envelope surrounding said arc tube, said envelope including a base, said luminaire comprising:

a solenoidal excitation coil for exciting an arc discharge in said fill, the diameter of the circular cross section of said excitation coil being greater than that of said envelope so that said excitation coil is adapted to be disposed about said envelope; and coil retaining means for supporting said excitation coil, said coil retaining means being adapted to be connected to a radio frequency power supply for coupling radio frequency power to said fill.

18. An electrodeless high intensity discharge lamp which is replaceable in a luminaire including a socket and having a solenoidal excitation coil connected thereto, said lamp comprising:

a light-transmissive arc tube for containing a fill an elongated, substantially cylindrical, light-transmissive envelope disposed about said arc tube and including a base, the diameter of the circular cross-section of said envelope being less than that of said excitation coil so that said envelope is readily adaptable for insertion through said excitation coil, said base being adapted for insertion into the socket of the luminaire, said envelope being supported by the socket of the luminaire; and light-reflecting means disposed within said envelope for reflecting light radiated from said arc tube through said envelope.

19. A lamp according to claim 18 wherein said light-reflecting means comprises a light-reflecting cone disposed at each end of said envelope and along the longitudinal axis thereof.

20. A lamp according to claim 19 wherein each said light-reflecting cone comprises a metal coated with a diffuse reflecting material.

21. A lamp according to claim 20 wherein said diffuse reflecting material comprises barium sulfate.

22. A lamp according to claim 20 wherein said diffuse reflecting material comprises an oxide selected from the group consisting of alumina, magnesia and titania.

23. A lamp according to claim 20 wherein said diffuse reflecting material comprises phosphor.

24. A lamp according to claim 19 wherein each said light-reflecting cone is comprised of a dielectric material coated with a diffuse reflecting material.

25. A lamp according to claim 24 wherein said dielectric material comprises glass and said diffuse reflecting material comprises phosphor.

26. A lamp according to claim 18, further comprising getter means for removing impurity gases from the space between said arc tube and said envelope.

27. A lamp according to claim 18, further comprising thermal energy barrier means for insulating said arc tube.

28. A lamp according to claim 18, further comprising starting electrode means for providing at least one spark channel within said envelope to assist in the initiation of said arc discharge upon receipt of a starting signal.

29. A lamp according to claim 28 wherein said starting electrode means comprises an elongated electrode disposed at each end of said envelope and along the longitudinal axis thereof.

30. A lamp according to claim 29 wherein each said electrode is exterior and adjacent to said arc tube.

31. A lamp according to claim 30 wherein each said electrode provides support for said arc tube.

32. A lamp according to claim 29 wherein each said electrode extends from one end of said envelope into said arc tube.

* * * * *